United States Patent [19]

Ryno

[11] 4,131,413

[45] Dec. 26, 1978

[54] SELF-CONTAINED ELECTRIC IGNITER WITH RECHARGEABLE BATTERY

[75] Inventor: Robert W. Ryno, Mequon, Wis.

[73] Assignee: A. O. Smith Corporation, Milwaukee, Wis.

[21] Appl. No.: 831,751

[22] Filed: Sep. 9, 1977

[51] Int. Cl.[2] ..... F23Q 9/08

[52] U.S. Cl. ..... 431/44; 431/51; 431/52; 431/61

[58] Field of Search ..... 431/44, 51, 52, 55, 431/61

[56] References Cited

U.S. PATENT DOCUMENTS

| | | | |
|---|---|---|---|
| 3,174,534 | 3/1965 | Weber | 431/44 |
| 3,174,535 | 3/1965 | Weber | 431/44 |

*Primary Examiner*—Carroll B. Dority, Jr.

*Attorney, Agent, or Firm*—Andrus, Sceales, Starke & Sawall

[57] ABSTRACT

A self-contained electric igniter in which the ignition pilot is actuated by a rechargeable battery to supply energy for the spark provided by an igniter. All energy for opening the valve of the main gas valve is supplied by a millivolt thermopile generator which together with additional thermopiles charges the battery. A diode is located in the battery charging line to prevent reverse flow of current from the battery to the thermopiles. The system has a safety valve which closes off flow of gas into the system in the event the pilot burner fails to ignite and a flame switch which closes off the flow of current to the main gas valve and consequent flow of gas into the system in the event the pilot burner is extinguished. It also has a damper control system which is closed when the system is shut off to reduce stand-by losses and conserve energy.

10 Claims, 5 Drawing Figures

SELF-CONTAINED ELECTRIC IGNITER WITH RECHARGEABLE BATTERY

BACKGROUND OF THE INVENTION

In igniter systems for gas burning heating units particularly those using propane or butane gas it is necessary that the system be provided with a hundred percent shut off in the event of ignition failure. Representative of the prior art is Weber U.S. Pat. No. 3,174,535. This patent has no shut off valve such as employed in the present system to provide a hundred percent shut off of gas flow into the system in case of failure of the ignition system. Nor does the Weber patent disclose a flame switch shut off of the main gas valve in the event the pilot flame is extinguished. Nor does the Weber describe or show means in the battery charging line which prevents reverse flow of the current from the battery to the charging thermopiles of the system nor a damper control system to reduce stand-by losses.

SUMMARY OF THE INVENTION

The invention is directed to an ignition system for a gas operated heating unit which is actuated by a battery charged preferably by thermopile generators.

When the thermostat calls for gas, gas flows into the system through a normally open safety valve into engagement with a pilot pressure switch and thence to a pilot burner. The pilot pressure switch is actuated by the incoming gas to set up an electrical circuit between a rechargeable battery and igniter which energizes the latter to supply a spark which in turn ignites the pilot burner.

The pilot burner heats a first thermopile and applies some heat also to a second and third thermopile. The first thermopile provides a flow of current which opens the main gas valve and sets up a flow of incoming gas to the main gas burner which is ignited by the pilot burner. The main gas burner then provides additional heat to the thermopiles which develop a voltage of the order of 750 millivolts each.

The flow of gas to the main burner also actuates a pressure burner switch to set up a circuit from the thermopiles to the battery and return and the thermopiles thereby provide current to charge the battery.

About the same time a bi-metallic rod is heated by the flame of the pilot burner and this opens a flame switch which permits the flow of current in the lines between the first thermopile and the main gas valve for opening the latter.

When the thermostat is satisfied the flow of gas into the system is cut off and the main gas burner and pilot burner are extinguished and the switches of the pilot pressure switch and burner pressure switch return to their starting position.

The flame switch also closes to prevent flow of current to the main gas valve.

In the event gas flowing into the system does not ignite the pilot burner because of some malfunctions of the ignition system or other malfunction, the safety valve closes which cuts off the flow of gas into the system and the entire system is shut down and the safety valve thus provides a one hundred percent shut off.

In addition another important feature is a diode connected in the line from the thermopiles to the battery which prevents reverse flow of current when the battery is being charged.

Furthermore the system conserves energy because the dampers in the unit are closed when the system is shut off to thereby reduce stand-by losses.

DESCRIPTION OF THE DRAWING

The drawing furnished herewith illustrates a preferred construction of the present invention in which the above advantages and features are clearly disclosed as well as others which will be readily understood from the following description.

DESCRIPTION OF PREFERRED EMBODIMENT

Figure 1:
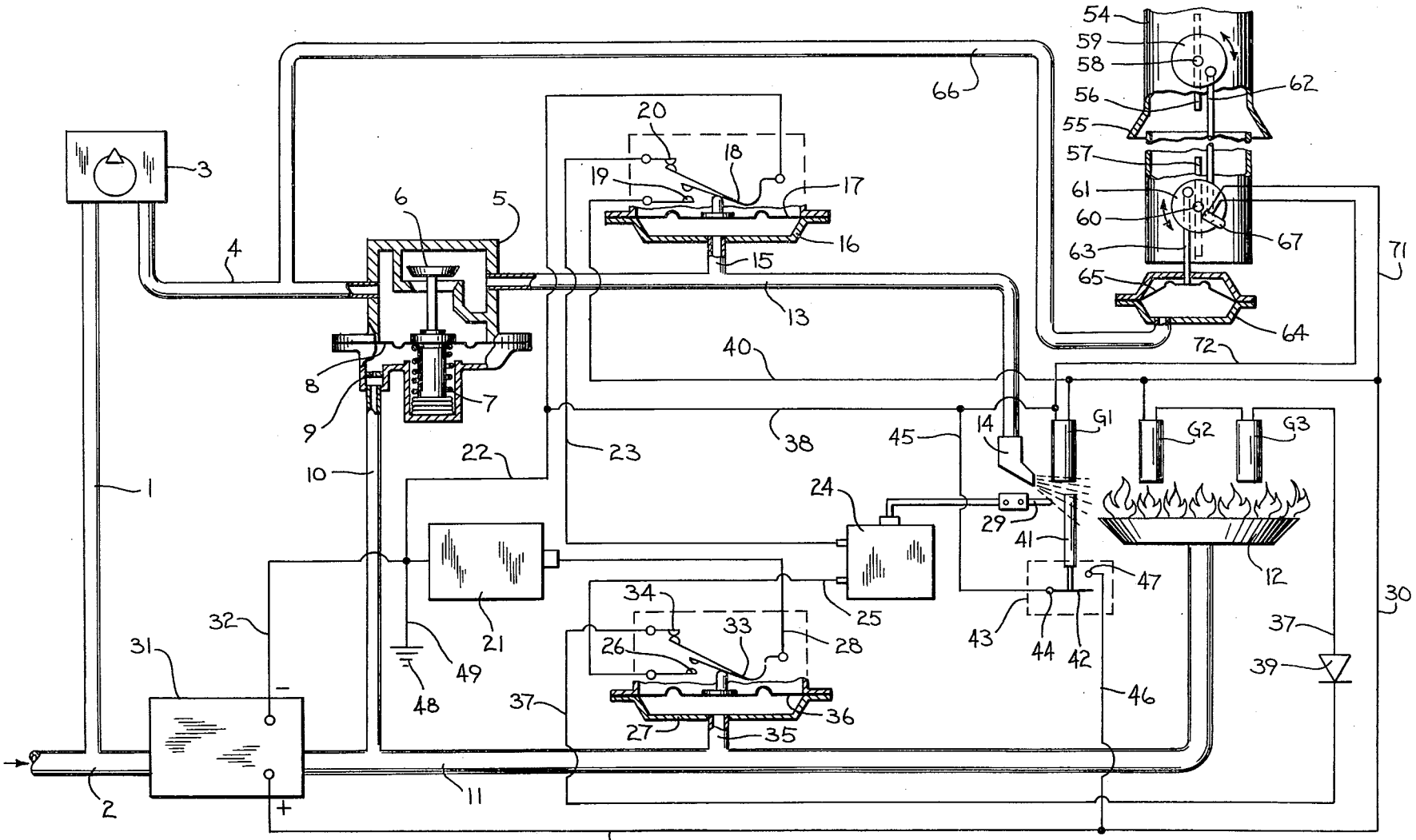
FIG. 1 is a schematic view of the entire system of the invention in a fully operational condition.

Referring to FIG. 1 of the drawing there is shown conduit 1 which is connected between the gas inlet conduit 2 and the temperature control valve or thermostat 3. When thermostat 3 calls for heat the valve, not shown, of thermostat 3 opens, and gas flows from inlet conduit 2 through conduit 1 and through thermostat 3 and thence through conduit 4 to the safety valve 5 and then through valve 6 thereof which is normally biased open by the spring 7 which engages the lower side of the diaphragm 8.

Normally the gas pressures on both sides of diaphragm 8 are equalized as gas and air is provided beneath diaphragm 8 through bleeder orifice 9 which is connected through conduit 10 to the main gas burner conduit 11 which supplies gas to gas burner 12 when the system is in operation. Safety valve 5 remains open and valve 6 is unseated and gas continues to flow through shut-off valve 6 so long as everything is operating properly in the system.

Figure 2:
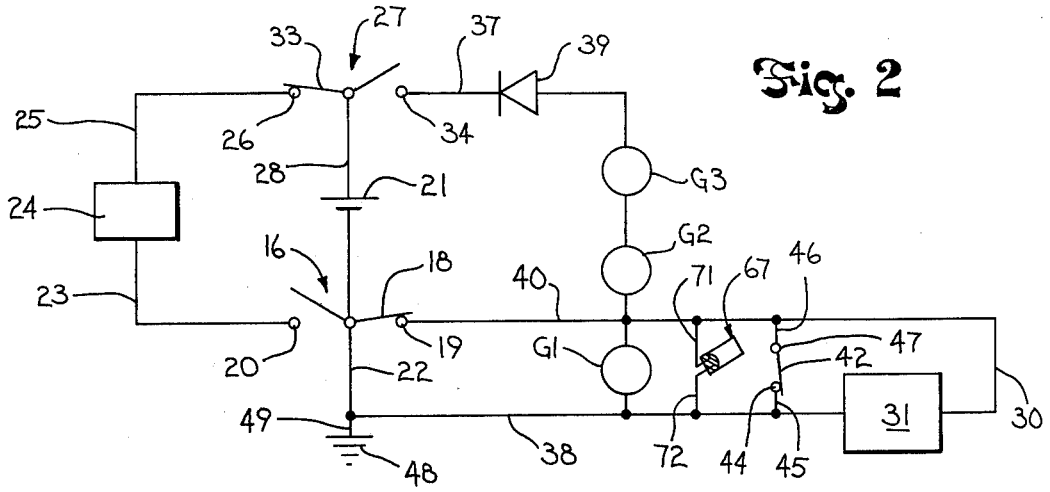
FIG. 2 is a schematic view of the system with the system in inoperative condition.

The incoming gas after leaving shut-off valve 5 then flows in conduit 13 to pilot burner 14 and also flows through conduit 15 connected to conduit 13 and into the pilot pressure switch 16 beneath the diaphragm 17. Pressure switch 16 is normally closed, as shown in FIG. 2, by pivoting switch 18 into engagement with contacts 19 but the pressure of the gas on diaphragm 17 results in the switch 18 pivoting into an open position in engagement with contact 20 as shown in FIG. 1. This causes current in the system to flow from the rechargeable battery 21, preferably of the nickel cadmium type through line 22, pressure switch 16, and line 23 to the igniter 24 which operates on the order of 1.2 volts and thence through line 25 to contact 26 of pressure switch 27 which at that time is normally closed as shown in FIG. 2 and through line 28 back to the battery 21 to complete the circuit.

When the described flow of current to igniter 24 is completed the latter is energized and gives off a spark as at 29 to ignite pilot burner 14.

Heat from the pilot flame contacts G1 which is preferably a millivolt thermopile generator and the flame is of a split type to also contact one side of the millivolt thermopile generators G2 and G3. Generators G1, G2 and G3 are located in series and together generate a voltage of the order of 1.75 volts.

Upon the heating of generator G1 a current is produced which flows through line 30 to actuate a solenoid, not shown, to open main gas valve 31 which then supplies gas from gas inlet conduit 2 to the main gas burner 12 through conduit 11. Upon flow of gas to main gas burner 12 pilot 14 ignites burner 12. The circuit is completed through line 32 leading from main gas valve 31 and back to generator G1.

When gas flows through conduit 11 to burner 12 it also enters conduit 35 of burner pressure switch 27 and engages diaphragm 36 to pivot switch 33 from contact 26, the normally closed position, and into engagement with contact 34 as shown in FIG. 1 and this cuts flow of current to igniter 24 and thereby to turn igniter 24 off.

The described movement of switch 33 of pressure switch 27 sets up a charging circuit through line 37 which is connected to thermopiles G2 and G3 and line 28 for charging battery 21. G2 and G3 are now heated by the main gas burner 12 to generate power. The circuit is completed by flow of current through line 38 to G1 from battery 21. Diode 39 which has a low forward voltage drop due to the limited charging voltage available is located in line 37. Diode 39 prevents reverse current flow from battery 21 so that there is no current drain of battery 21 during the warm-up period of thermopile generators G2 and G3.

When gas flows to the main gas valve 12 through conduit 11 it also flows through bleeder conduit 10 and bleeder orifice 9 to beneath diaphragm 8 of shut-off valve 5 which equalizes the pressure on both sides of diaphragm 8 so that spring 7 will hold valve 6 off its seat and shut-off valve 5 is therefore open.

When the thermostatic temperature control 3 is satisfied it closes and cuts off the flow of gas through conduits 4 and 13 to pilot burner 14 so that the pilot flame goes off at the same time flow of gas into pilot pressure switch 16 through conduit 15 from conduit 4 is terminated. Diaphragm 17 of pressure switch 16 then moves to a position to pivot switch 18 from contact 20 into engagement with contact 19 as shown in FIG. 2 which is the normally closed position of pilot burner switch 16. The current flow in the system is then short circuited through line 40 which shuts off the power from G1 to main gas valve 31 and the solenoid in valve 31, not shown, is moved to a closed position and cuts off the flow of gas to the main gas burner 12.

When the pressure in the main gas burner 12 drops to zero the gas pressure beneath the diaphragm 36 of burner pressure switch 27 also decreases to zero so that switch 33 of pressure switch 27 pivots from contact 34 into engagement with contact 26 as shown in FIG. 2. This breaks the charging circuit between G1, G2 and G3 and battery 21 thereby preventing a possible drain of power from battery 21 through the thermopile circuit and diode 39.

After the pilot burner 14 and the main gas burner 12 are off, the pressure on both sides of diaphragm 8 of safety valve 5 is equalized and the spring 7 holds valve 6 of safety valve 5 open.

In the event that thermostat 3 calls for gas and the gas then flows through safety valve 5 to pilot burner 14 and the latter fails to ignite then valve 6 of safety valve 5 within a predetermined number of seconds closes and shuts off the gas flow therethrough. The shut-off is effected by the continual flow of gas through safety valve 5 when pilot burner 14 fails to ignite which then depresses diaphragm 8 as gas beneath diaphragm is forced out through bleed orifice 9 and into conduit 10. When this occurs the pressure on the incoming gas side of diaphragm 8 is greater than the pressure beneath diaphragm 8 which then forces spring 7 downwardly to close valve 6 and cuts off the flow of gas to pilot burner 14. The safety valve 5 thus acts as a one hundred percent shut-off of gas flow within thirty to sixty seconds.

Another safety feature of the system consists of the bi-metallic rod 41 which is located so that it can be engaged by the pilot flame as shown in FIG. 1 and one end of the rod is connected to the flame switch 42 within housing 43. The contact 44 of switch 42 is connected through line 45 to line 38 of the G1 circuit and a second line 46 is connected to contact 47 and to line 30 of the G1 circuit.

When pilot 14 which is normally out as in FIG. 2 is lit and this expands rod 41 and flame switch 42 opens when switch 42 disengages contact 47. This opens the circuit through lines 45 and 46 and allows current to flow between G1 and the main gas valve 31. In the event the pilot burner 14 goes out for some reason then the contacts 44 and 47 close such as in about four seconds as rod 41 decreases in length and this closes the circuit through lines 30 and 38 shunting the current from G1 causing the gas valve 31 to close, shutting down main gas burner 12 and the system.

Figure 3:
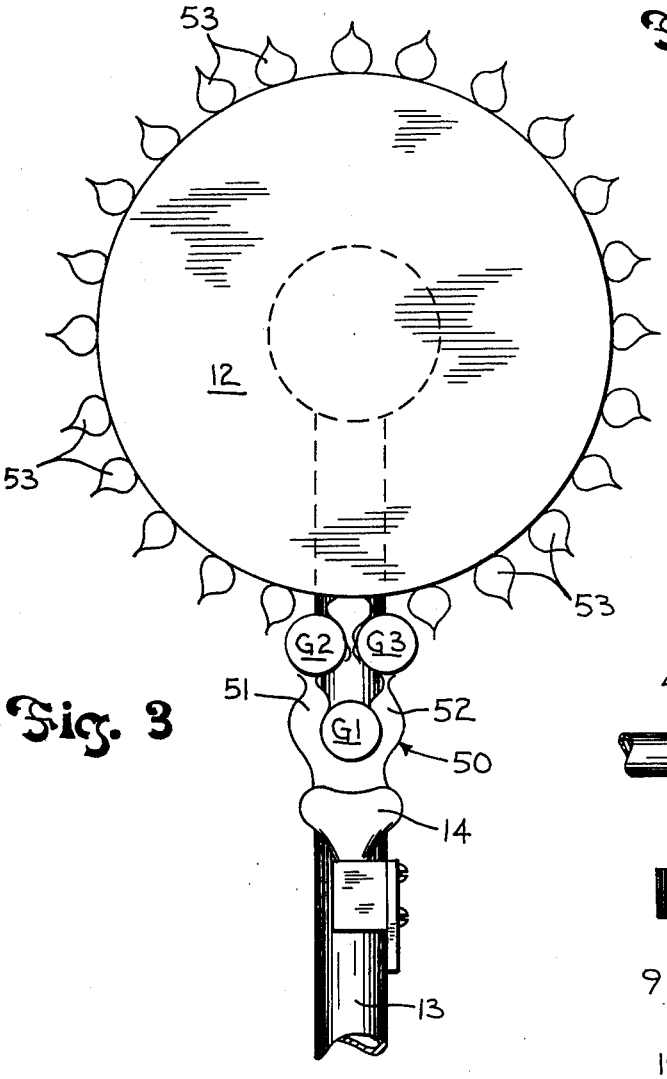
FIG. 3 is a top plan view illustrating the location of the millivolt generators with relation to the flame of the pilot burner.

Referring now to FIG. 3, this figure illustrates the mechanical positioning of the respective thermopiles G1, G2 and G3 with respect to the pilot burner 14 and main gas burner 12.

Thermopile G1 is located adjacent to the pilot burner 14 which receives gas from conduit 13 so that flame 50 which is of the split type engages and generally encircles G1, and then splits into the two tongues 51 and 52. Thermopiles G2 and G3 are located in side by side relation back of G1 so that the forward side of G2 is engaged by flame tongue 51 and the forward side of G3 by flame tongue 52. After ignition of the main gas burner 12 the flames 53 of burner 12 engage the rear side of G2 and G3 and somewhat encircle G2 and G3.

Figure 5:
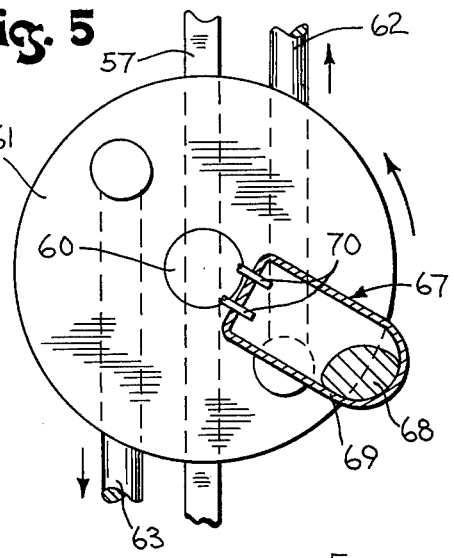
FIG. 5 is a detail view of the mercury switch shown in FIG. 1 in open position.
Figure 4:
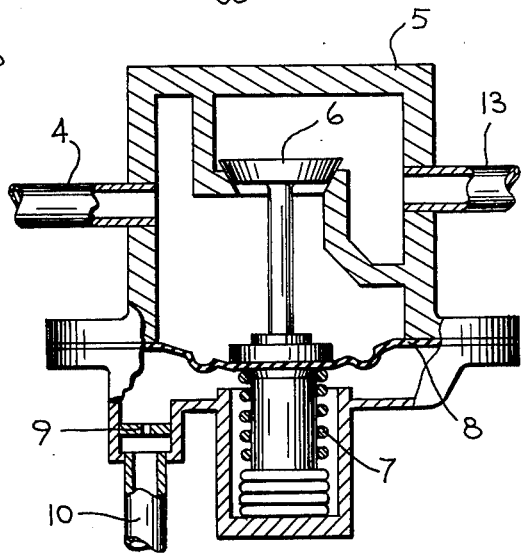
FIG. 4 is a detail view with parts in section of the safety valve in a closed position.

FIG. 1 and FIG. 5 also illustrate an energy saving feature of the invention. The invention has a number of uses such as for example a commercial tank type water heater having a capacity such as 75 to 100 gals. storage capacity and a 100,000 to 700,000 b.t.u. gas input per hour. When the gas heating unit is shut off it is desirable that there is a minimum loss of heat when the heater is on stand-by.

FIG. 1 diagrammatically illustrates a flue construction into which the gases from burner 12 would be discharged. The flue 54 located over burner 12 has a hood 55 so that air may be drawn into the flue. Flue 54 has an upper damper 56 located above hood 55 to control the flow of air and air and gas through the flue and a lower damper 57 to control the flow of gas. The upper damper 56 is secured to a horizontal rod 58 which projects through flue 54 to rotate therein and in turn is secured to the upper actuator 59. Likewise the lower damper 57 is secured to a rod 60 which rotatably extends through flue 54 and is secured to the lower actuator 61.

The actuators 59 and 61 are joined by linkage 62 which is secured to each actuator adjacent the outer circumference of each actuator. The lower actuator 61 is shown as connected to the piston 63 which projects through the gas operator 64 and is secured to the diaphragm 65 inside of gas operator 64.

The area in gas operator 64 beneath diaphragm 65 opens to the gas conduit 66 connected to operator 64 which in turn is connected to the gas line 4 leading from thermostat 3. When the system is operational and gas is flowing in gas conduit 4 it passes through gas conduit 66 and beneath diaphragm to thereby raise the diaphragm and raise piston 63 and the described linkage 62 to thereby rotate actuators 59 and 61 to thereby rotate dampers 56 and 57 to an open position.

The lower actuator 61 is also provided with a mercury switch 67 which is better shown in an enlarged view illustrated in FIG. 5. The switch 67 there is in the open position and consists of a ball of mercury 68 which rolls within the container 69.

In the open position the ball 68 has rolled out of engagement with the contacts 70. One of the contacts 70 is connected by line 71 to line 30 and the other contact 70 is connected by line 72 to line 38. In the open position of mercury switch 67 the dampers 56 and 57 are in the open position as previously described because the system as shown in FIG. 1 is operational.

In FIG. 2 mercury switch 67 is shown in the normally closed position and in parallel with the pilot burner switch 16 and the flame switch 42 and the dampers 56 and 57 are closed. In the closed position of the dampers only a minimum of hot air and combustion gas can pass up the flue and similarly the flow of air through the upper damper from the room in which the heating unit is located is minimized.

As described the pilot switch 16, the flame switch 42 and the mercury switch 67 are disposed in parallel and are normally closed in shunt across gas valve 31. This permits the use of light wire and does not add series resistance due to contacts. Because of the low voltage employed in the system any additional resistance in series over the resistance of the solenoid coil of gas valve 31 would seriously affect the operation of the system and no special low resistivity contacts are required.

FIG. 2 illustrates the systems when the pivoting switch 18 of pilot pressure switch 16 is in the normally closed position in engagement with contact 19. The battery 21 is disconnected from G1, G2 and G3 because the pivoting switch 33 of burner pressure switch is in engagement with contact 26 which is the normally closed position of switch 33. Switch 18 and contact 19 shorts out the solenoid, not shown, of the main gas valve 31, thus shutting off main burner 12 as soon as the gas thermostat 3 is satisfied. Otherwise the main gas valve 31 would remain open until the thermopile G1 had cooled sufficiently to drop the solenoid in valve 31 or the flame switch 41 cools and shorts out solenoid in valve 31.

The main gas valve 31 is closed so that no gas is flowing to the main burner 12 nor at this time is any gas flowing to the pilot burner 14 so that G1, G2 and G3 are not in charging operation and line 37 through diode 39 is carrying no current. In addition flame switch 42 is closed so that no current can flow to main gas valve 31 through line 30 and so is mercury switch 67 closed so that the dampers 56 and 57 are closed.

The entire system is connected to ground 48 through line 49 as shown in FIGS. 1 and 2.

Besides the safety feature of the system provided by safety valve 5 and flame switch 42 the construction has other advantages.

Thus in the event pilot burner 14 should be extinguished due to an excess of air or a draft, spark igniter 24 will function until pilot burner 14 and main gas burner 12 are lit.

The diode 39 provides an important function in that flow of current from the battery charging thermopiles G2 and G3 is held up until the charging voltage exceeds the voltage of battery 21.

The three thermopiles G1, G2 and G3 are connected in series for a maximum charging voltage using standard 750 MV units.

The use of a burner pressure switch 27 which is identical to the pilot pressure switch 16 eliminates timing problems and burner pressure 27 cannot operate until there is sufficient heat for the G1 thermopile to open main gas valve 31.

The use of a split flame from the pilot 14 and a mechanical arrangement is an important feature of the system whereby the pilot flame heats G1 and also the one side of G2 and G3 to almost immediately initiate the production of a charge voltage in excess of 1.5 volts.

When setting of thermostat 3 is satisfied the main gas burner 12 shuts down immediately. In the event the burner is then reset to call for heat right after shut down, igniter 24 will be energized and main gas burner 12 immediately lit by pilot burner 14. Furthermore when there is no gas pressure and thermostat 3 is calling for heat, the system will remain inoperative because pilot pressure switch 16 will be closed and flow of current to igniter 24 will thereby be prevented.

With the dampers 56 and 57 in closed position standby loss of heat is minimized and energy is conserved.

The above description and drawings set forth the best mode presently contemplated by the inventor of carrying out his invention.

Various modes of carrying out the invention are contemplated as being within the scope of the following claims particularly pointing out and distinctly claiming the subject matter which is regarded as the invention.

I claim:

1. A self-contained ignition system for a gas burning heating unit having a pilot burner and a main gas burner, which comprises conduit means to conduct incoming gas to the pilot burner and the main gas burner, a rechargeable battery of a predetermined capacity located in the system, an igniter electrically connected to the battery, a pilot pressure switch activated by the pressure of the gas flowing to the pilot burner to initiate current flow from the battery to the igniter and thereby provide a spark from the igniter to ignite the gas flowing from the pilot burner, a main gas valve controlling the flow of gas through the main gas burner conduit means to the main gas burner, a voltage generating means located adjacent the pilot burner and actuated by the flame of the burner to produce a voltage providing a current to electrically open the main gas valve, additional voltage generating means in series with the first generating means and located adjacent the first named generating means and heated by the main gas burner to generate a predetermined voltage, a burner pressure switch connected to the main gas burner conduit means and actuated by the pressure of the gas in the main gas burner conduit means to establish an electrical circuit between the voltage generating means and the battery to recharge the battery and means in the circuit between the battery and the voltage generating means to prevent reverse flow of current from the battery to the generating means and a safety valve disposed in the pilot burner conduit means and constructed to close within a predetermined length of time in the event the pilot burner fails to ignite the incoming gas.

2. The self-contained ignition system of claim 1 and a flame switch unit comprising a bi-metallic rod, a switch connected to the rod, a pair of lines connecting the switch across the electrical circuit from the voltage generating means to the main gas valve, and the metallic rod disposed in a position to be heated by the flame of the pilot burner so that when the flame is heating the rod the latter expands and opens the flame switch to complete the electrical circuit between the voltage generating means and the main gas valve and when the flame is extinguished the rod contracts and closes the switch to short the electrical current between the voltage generating means and the main gas valve.

3. The self-contained ignition system of claim 1, and the means to prevent reverse flow from the battery to the voltage generating means being a diode.

4. The self-contained ignition system of claim 1, and the voltage generating means comprising a first thermopile and a second and a third thermopile, and a mechanical arrangement of the respective thermopiles whereby the first thermopile is adjacent the pilot burner and the second and third thermopiles are located side by side in slightly spaced relation behind the first thermopile and spaced therefrom, and the flame of the pilot burner being provided as the split flame type to engage and encompass the first thermopile and then splitting into two tongues of flame to contact the side of the second and third thermopiles most removed from the main gas burner.

5. The self-contained ignition system of claim 4 and the thermopiles generating 750 millivolts each, and the battery having a capacity of approximately 1½ volts.

6. The self-contained ignition system of claim 1 and the safety valve comprising an internal valve, a diaphragm connected to the valve, a spring connected to the diaphragm and valve and set to exert a predetermined pressure normally biasing the valve to an open position when the pressure on the diaphragm is equal on both sides, a bleed orifice on the one side of the diaphragm, a conduit connecting the bleed orifice to the main gas valve conduit means to supply gas and air to the safety valve through the bleed orifice to one side of the diaphragm and the gas flowing through the valve on the other side of the diaphragm to the pilot burner normally equalizing the pressure on the valve, said safety valve being closed by a build-up of pressure of incoming gas overcoming the spring and discharging gas on the one side of the diaphragm from the valve through said orifice when the pilot burner fails to light the incoming gas.

7. The self-contained ignition system of claim 1, and the pilot pressure switch having an internal switch and spaced contacts connected to the electrical circuit, and a diaphragm to actuate the switch into engagement with one or the other contacts to place the switch in a normally open or normally closed position.

8. The self-contained ignition system of claim 7, and the burner pressure switch having a construction corresponding to the construction of the pilot pressure switch.

9. The self-contained ignition system of claim 1, and a flue connected to the system to discharge combustion gases, damper means rotatably disposed in the flue, a gas operator located adjacent the lower portion of the flue and having a diaphragm disposed on the inside and dividing the gas operator into an upper and lower chamber, a conduit connected to the conduit means and to the gas operator to conduct incoming gas to the lower chamber of the gas operator, a piston extending through the upper chamber of the gas operator and connected to the diaphragm, actuator means connected to the damper means, linkage connecting the actuator means to the piston, a flue switch connected to the actuator means, and the linkage and piston rotating the actuator means to rotate the damper to an open or closed position and move the flue switch to an open or closed position when gas is discharged or removed from the chamber beneath the diaphragm to raise and lower the piston, linkage and actuator, and lines connecting the flue switch into the electrical portion of the ignition system.

10. The self-contained ignition system of claim 9, and a flame switch unit comprising a metallic rod, a switch connected to the rod, a pair of lines connecting the switch across the electrical circuit from the voltage generating means to the main gas valve, and the metallic rod disposed in a position to be heated by the flame of the pilot burner so that when the flame is heating the rod the latter expands and opens the flame switch to complete the electrical circuit between the voltage generating means and the main gas valve and when the flame is extinguished the rod contracts and closes the switch to short the electrical circuit between the voltage generating means and the main gas valve, contacts provided as a part of each switch, and the pilot pressure switch, the flue switch and the flame switch being disposed in parallel and normally closed in shunt across the main gas burner when the system is inoperative to thereby eliminate series resistance due to the contacts and permit use of low voltage in the system.

* * * * *